US005456615A

United States Patent [19]

Tang et al.

[11] Patent Number: 5,456,615

[45] Date of Patent: Oct. 10, 1995

[54] C TYPE LAMP STRING IMPROVEMENT

[75] Inventors: Fuh-Chyun Tang; Sheng-Lung Wu; Jiann-Chyun Kang; Chih-Min Lin, all of Hsinchu, Taiwan

[73] Assignee: Industrial Technology Research Institute, Hsinchu, Taiwan

[21] Appl. No.: 122,910

[22] Filed: Sep. 16, 1993

[51] Int. Cl.[6] ..... H01R 11/20

[52] U.S. Cl. ..... 439/419; 439/613

[58] Field of Search ..... 439/419, 611, 439/613, 619, 414

[56] References Cited

U.S. PATENT DOCUMENTS

| | | | |
|---|---|---|---|
| 2,273,645 | 2/1942 | Johnson | 439/613 |
| 3,128,141 | 4/1964 | Krupp et al. | 439/419 |
| 3,597,725 | 8/1971 | Beck et al. | 439/419 |

*Primary Examiner*—Daniel W. Howell

*Attorney, Agent, or Firm*—W. Wayne Liauh

[57] ABSTRACT

This invention relates to a C type lamp string improvement, comprising a lamp holder, a first contact piece, a second contact piece and a cord, wherein said lamp holder is such designed as to be integrally molded together. Said first contact piece and second contact piece may contact each pole of the bulb respectively, and one end of each has a sharp point for piercing the covering of the cord while contacting the core of the cord to achieve good conductivity, and said second contact piece has a proper number of projecting points at intervals equivalent to the pitches of the bulb thread to substitute for the conventional lamp holder thread. For manufacture, the first step is to insert the first and second contact pieces into the mold for making said lamp holder, and then place said cord within said injecting mold to enable said first and second contact pieces to pierce the covering of said cord with the sharp point, and wait until the integration of the injecting mold then the lamp holder will be integrally molded while cord and first and second contact pieces are integrated within the lamp holder.

4 Claims, 5 Drawing Sheets

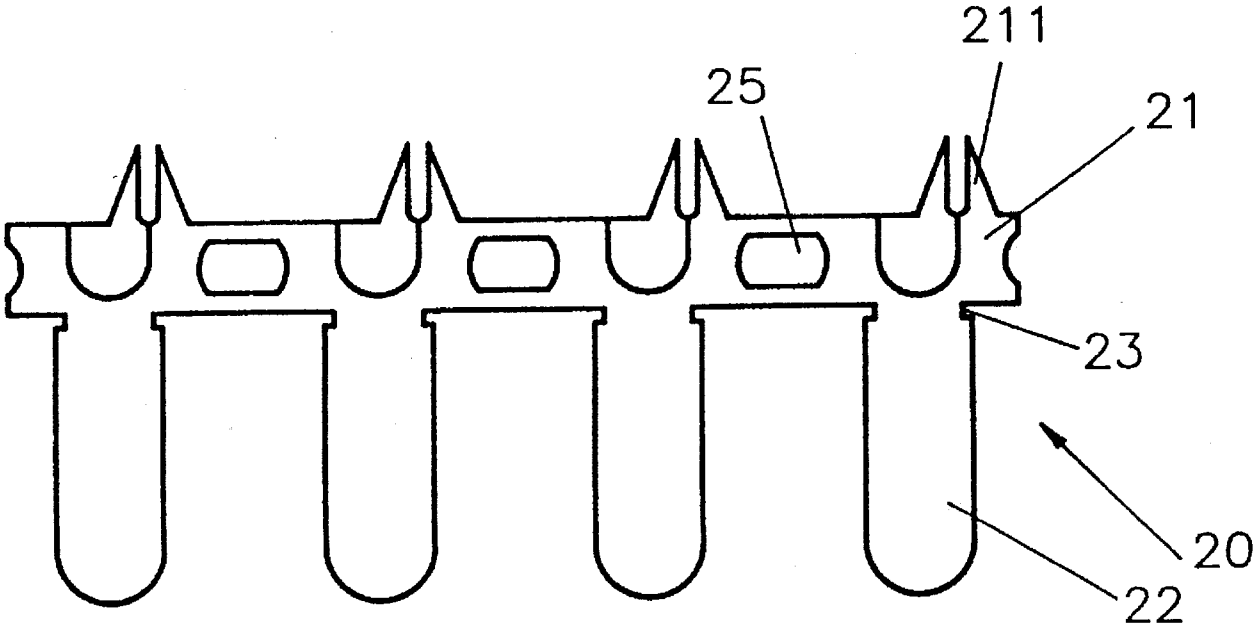
FIG—3
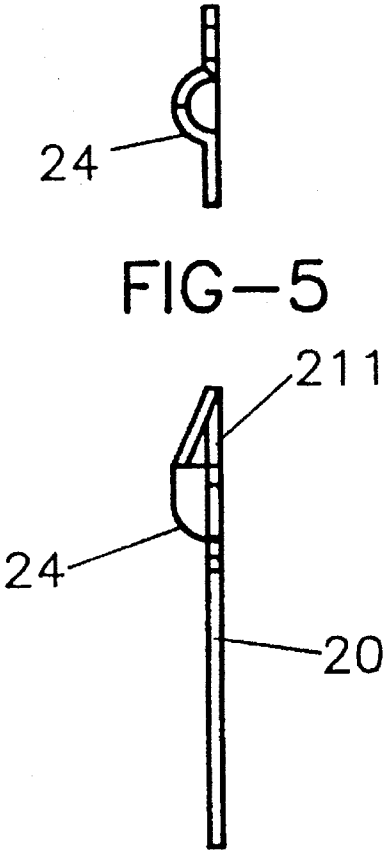
FIG—5
FIG—4

C TYPE LAMP STRING IMPROVEMENT

FIELD OF THE INVENTION

This invention relates to a C type lamp string improvement, and particularly to an improved C type lamp string that is suitable for automatic assembly with the advantages of safety, a handsome outlook and a long life span.

BACKGROUND OF THE INVENTION

The manufacture of the conventional C type lamp string includes lamp holder and two cover parts, after integrally injecting formation respectively, copper contact pieces are thus inserted in the lamp holder, double-row power cords placed on the lamp holder by labor. Then the lamp holder is tightly pressed together with the lamp cover securely fastened. The manufacture of the conventional lamp string is labor intensive and not possible for automatic production. This has resulted in slow production speed and higher production cost. In addition, upon completion of parts assembly the necessary, storage and handling increase freight cost and waste factory space. Further because of splicing between the lamp cover and holder of the conventional C type lamp string, when influenced by external force, they could easily separate from each other to cause power leakage or a short circuit. Therefore the conventional C type lamp string is not reliable and safe for use.

In addition, the holder of the conventional C type lamp string must be made with an internal thread for locking the bulb therein so that the lamp holder and cover must be manufactured individually rather than integrally injected in one step. Further the outer design for the copper contact pieces of the conventional C type lamp string can only be constructed as a single component followed by assembly of the copper contact piece with the lamp holder by hand. Owing to the aforesaid reasons, the conventional C type lamp string can only be assembled by hand rather than by automatic production and assembly.

In view of the obvious defects found in the conventional C type lamp string, the inventor has devoted himself to seeking improvement and hence has developed the present invention through persistent testing.

SUMMARY OF THE INVENTION

One object of this invention is to provide a C type lamp string improvement which is suitable for mass production.

Another object of this invention is to provide a C type lamp string safety improvement.

Still another object of this invention is to provide a C type lamp string improvement with a handsome appearance.

These and other objects and advantages of this invention will become apparent to those skilled in the art after consideration of the following detailed specification together with the accompanying drawings.

BRIEF DESCRIPTION OF THE DRAWINGS

FIG. 3 is a flat view of the first contact piece in an unrolled shape.

FIG. 4 is a side view of the single first contact piece of this invention.

FIG. 5 is a top view of the single first contact piece of this invention.

DETAILED DESCRIPTION OF PREFERRED EMBODIMENT

Figure 1:
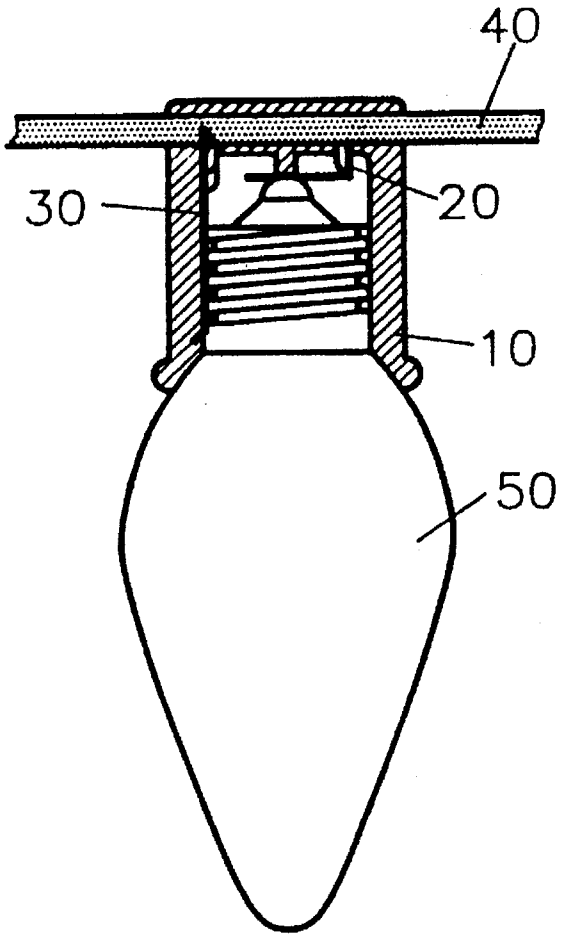
FIG. 1 is a front sectional view showing the interior structure of the present invention.
Figure 2:
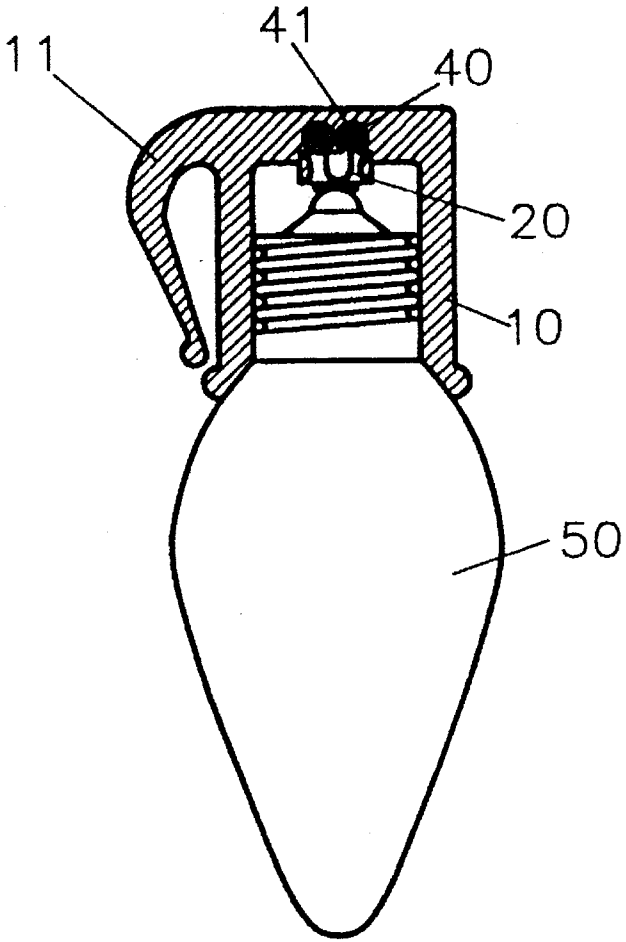
FIG. 2 is a side sectional view showing the position relationship of the first contact piece with the cord of the present invention.

Referring to FIGS. 1 and 2, the C type lamp string of the invention comprises a lamp holder 10, a first contact piece 20, a second contact piece 30 and double-row cords 40, wherein the lamp holder 10 is hence made without internal thread found in the conventional C type lamp string so that it can be integrally injected in formation. The external side of the lamp holder 10 has a lug 11 for hanging it on a tree or any other appropriate place for the C type lamp string to be hung in position securely. The interiors of the lamp holder 10 resemble a straight tubular hole for receiving a bulb. Referring to FIGS. 3 and 4 contact piece 20 and the second contact piece 30 both have fixing ends 21 and 31 respectively and each has a sharp point 211 or 311 for piercing through the double-row cords 40 while contacting the core 41 of the cords 40. For manufacture, (FIG. 9) insert the first contact piece 20 and second contact piece 30 into the mold slot for making the lamp holder 10 (FIG. 10). At the same time fixing end 21 is molded in plastic material integration with the lamp holder 10. After the two contact pieces and the lamp holder 10 are integrally molded by injection, the first contact piece 20 is then bent into a 90° corner by using an appropriate tool while the second contact piece is maintained straight so that the two contact pieces can contact each pole of the bulb respectively.

Referring to FIGS. 3, 4 and 5, the first contact piece 20 is made from a copper sheet or another kind of metal with good conductivity into a roll sheet through a continuous press, as shown in FIG. 3, and then sheared into a single contact piece which is inserted into the mold for making the lamp holder 10. The sharp point 211 attached to the fixing end 21 of the first contact piece 20. This is placed slightly deviating from the center line of the contact piece 20 to enable the sharp point 211 to contact either of the cores 41 of the power cord 40. The sharp point has two sharp projections for tightly holding the core 41 after the covering of the cord 40 is pierced by the sharp point 211. The sharp point 211 is firmly embedded with the core.

The junction between the fixing end 21 and contact end 22 of the first contact piece is pressed with a notch 23 for bending the contact end 22 into a 90° corner. The fixing end 21 also has a projection 24 for preventing the leakage of plastic material from splicing between fixing end 21 and the mold during the formation process of the lamp holder 10. This prevents plastic material leakage into the lamp holder 10 upon completion of injection. In addition, the roll sheet of the first contact piece 20 has a proper number of pressed holes 25 for placing the roll sheet of the first contact piece in position and for facility in shearing when the contact piece is sheared and inserted in the injection mold by means of automatic production equipment and mold.

Figure 6:
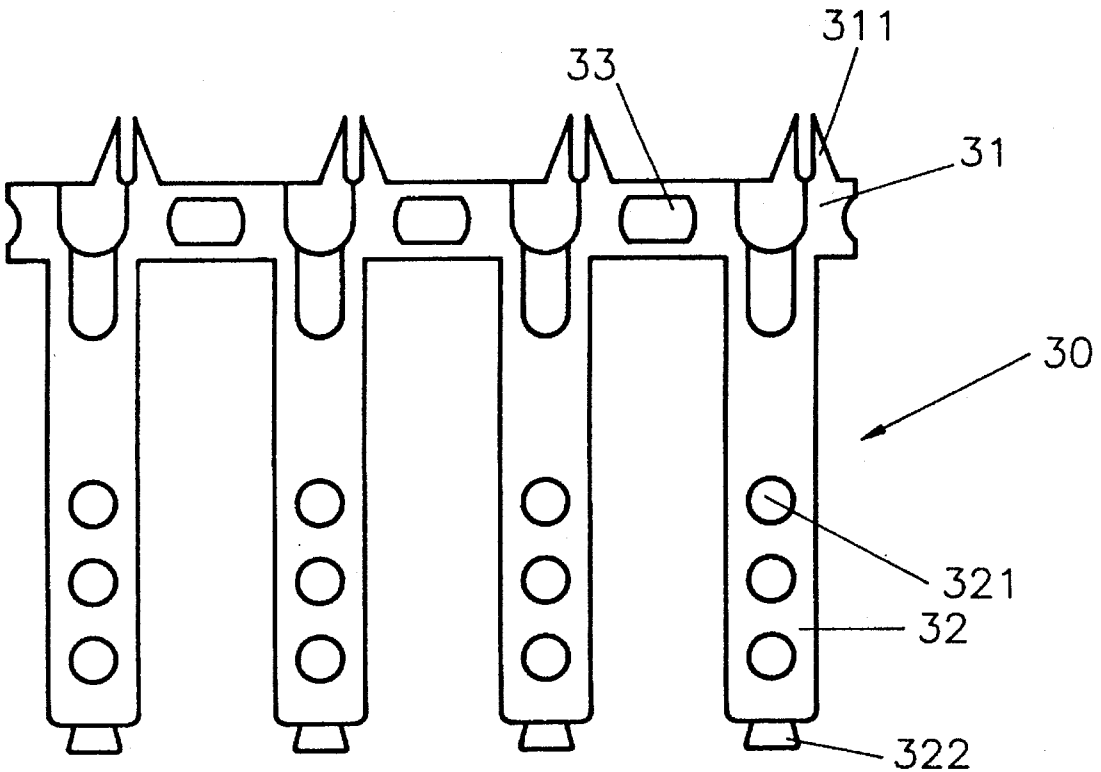
FIG. 6 is a flat view of the second contact piece in an unrolled shape.
Figure 8:
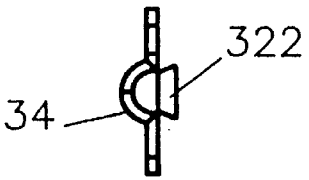
FIG. 8 is a top view of the single second contact piece of this invention.
Figure 7:
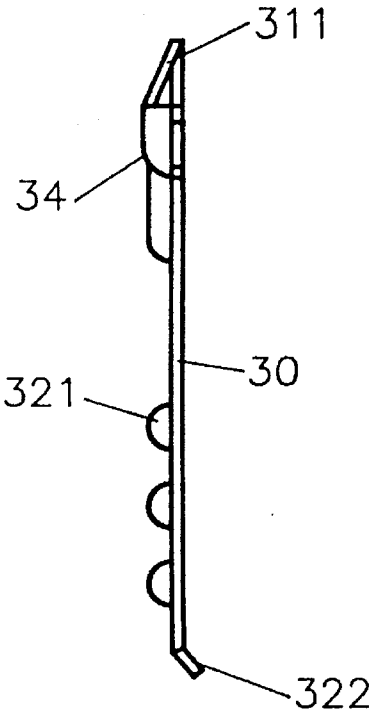
FIG. 7 is a side view of the single second contact piece of this invention.

Referring to FIGS. 6, 7 and 8, the second contact piece 30 of this invention is similar to the first contact piece in construction. The fixing end 31 has a sharp point 311 and a projection 34. The structure of the sharp point 311 is exactly the same as that of the sharp point 211 on the first contact piece 20. However, when the second contact piece is placed in the mold, the sharp point 311 and sharp point 211 are laid in a cross manner to each other so that the sharp point 211 and the sharp point 311 are made to contact different cores 41 of the cable 40 respectively.

When the second contact piece 30 molded on the lamp holder 10, it is maintained straight and on distal end of the contact end 32 has a projecting sheet 322 for increasing the firmness of installation within the lamp holder 10. Upon completion of the lamp holder injected in formation, the projecting sheet 322 is embedded in the plastic material of the lamp holder 10 to protect the contact end 32 against bending when in use.

The contact end 32 of the second contact piece 30 has a proper number of projecting points 321 arranged at the same intervals as the pitches of a bulb thread. These projecting points substitute for an internal thread of the lamp holder 10. They engage with the bulb thread.

Because of continuous and quick production design for both the first contact piece 20 and the second contact piece 30, they can thus be inserted in the mold for making the lamp holder 10 in an automatic and quick manner to fit automatic equipment. The substitute of the projecting points 321 on the two contact pieces for internal thread enables the lamp holder 10 to become simplified in shape for integrally injected forming in facility without need of assembling the two parts. The C type lamp string of this invention is simple in a manufacturing process while suitable for fast and automatic production.

Figure 9:
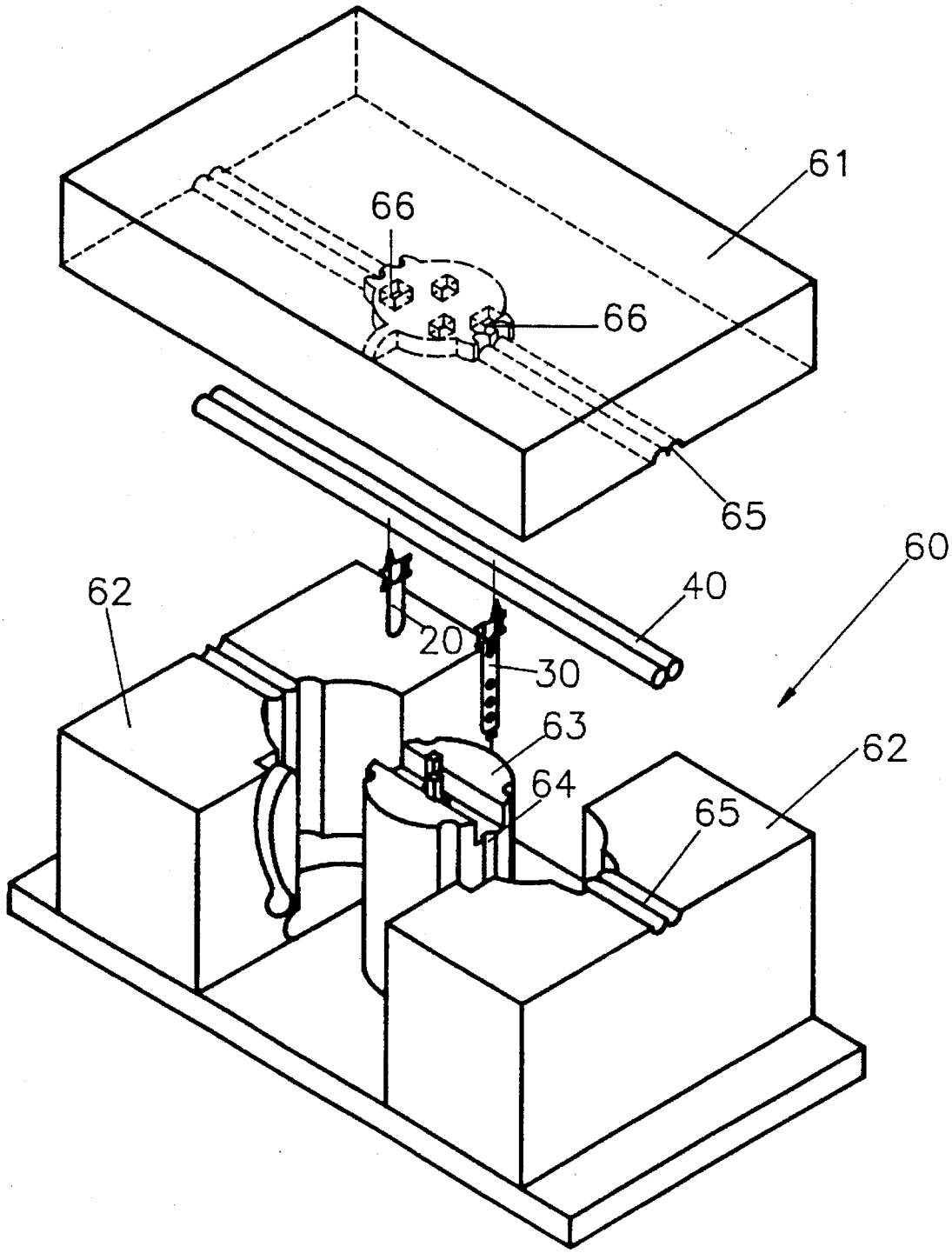
FIG. 9 is a diagramatic view of production, showing the shape of mold and way of production for this invention.
Figure 10:
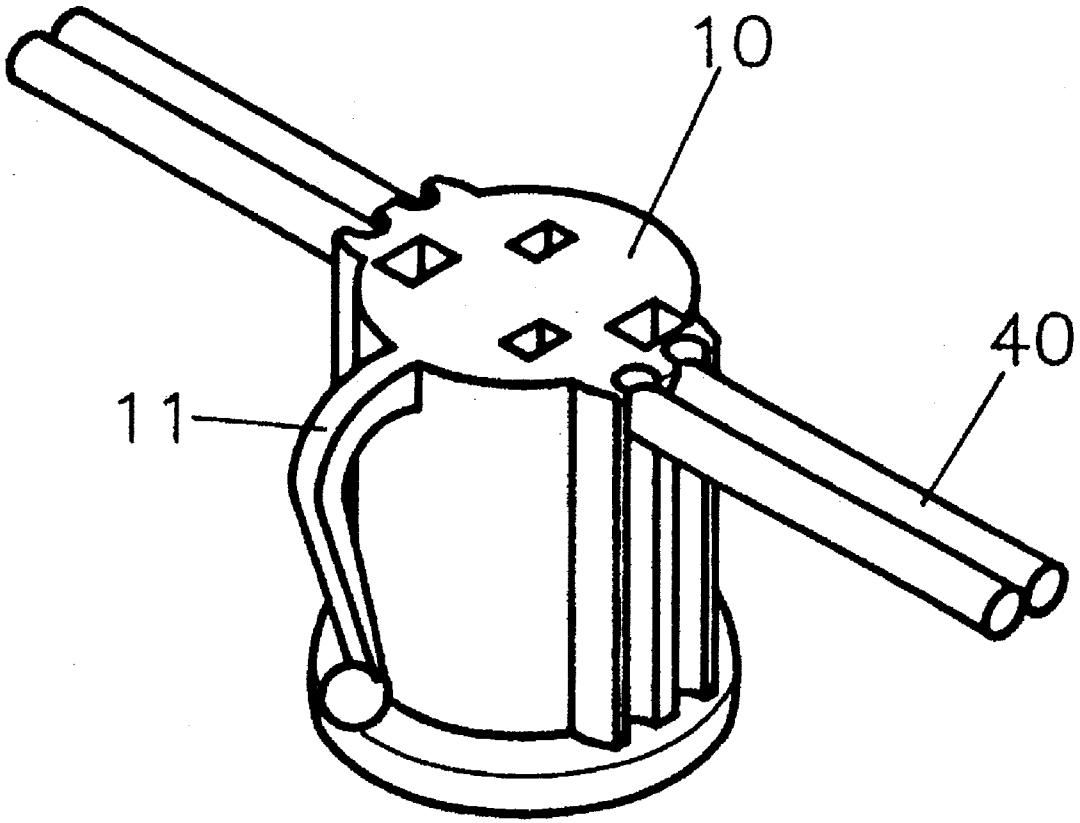
FIG. 10 is a perspective bottom view of the lamp holder of this invention.

Referring to FIG. 9, the mold comprises a lower mold 60, an upper mold 61, two slide blocks 62 and mold core 63. The mold core 63 is exactly the same as the interior shape of the lamp holder 10. The cave shape formed by the assembly of the upper mold 60, lower mold 61, two slide blocks 62 and the mold core 63 accounts for the shape of the lamp holder 10.

The mold core 63 has two mounting slots 64 for inserting the first and second contact pieces 20, 30 therein. The upper mold 61 and the integrated mold surface of the two slide blocks 62 of the lower mold 60 respectively has a groove 65. Upon integration of the upper mold and the lower mold, the grooves 65 will form the same shape as that of the slot of the cords 40 for accomodating the cords 40. When the cords 40 are placed in the slot, they extend over the mounting slots 64 of the mold core 63 so that the cords 40 may contact respective sharp points 211, 311 of the first contact piece 20 and second contact piece 30. The upper mold 61 has two crown pin holes 66 for placing the crown pins (not shown). The two crown pins may compress the cords 40 when the mold is integrated while enabling respective sharp points 211, 311 of the first and second contact pieces to pierce through the covering of the cable for contacting the core 41.

The manufacture of the C type lamp string of this invention by means of mold includes the first step of inserting the first and second contact pieces into the two mounting slots 64 of the mold core 63, and the second step by placing the cords 40 into the grooves 65, and the next by injecting plastic material into the cave of integrated mold, and finished product will be made until the plastic material sets and the mold is opened, as shown in FIG. 10.

According to the manufacturing process of this invention, only one injecting in formation is needed. In addition, it can be manufactured in a automatic and continuous production manner so that its production cost is decreased compared to the conventional C type lamp string. The lamp holder 10 of this invention is integrally molded with the first contact piece, second contact piece and cords 40 so that circuit connections are totally sealed within plastic material of the lamp holder 10 without risk of breaking away which promotes the safety and reliability of the product.

What is claimed is:

1. A C type lamp string comprising:

a lamp holder made of a plastic material, said lamp holder having a lug on an external side and a hole resembling a tubular shape internally;

a power cord having first and second cores;

a first contact piece having a first fixing end and a first contact end, wherein said first fixing end is connected to said lamp holder and having a first sharp point for piercing a covering of said power cord and contacting said first core of said cord;

said first contact end being bent at a 90 degrees angle relative to said first fixing end; and a second contact piece having a second fixing end and a second contact end, said second contact end being connected to said lamp holder and having a second sharp point for piercing the covering of said cord and contacting said second core of said cord, and said second contact end resembling a straight sheet shape;

wherein said lamp holder is integrally molded without internal thread made on the wall of the tubular hole therein;

said cord and first and second contact pieces being wrapped in said plastic material making up said lamp holder during an injection molding of said lamp holder and thus becoming integrated thereto;

said second contact end of said second contact piece having a plurality of projecting points at intervals equivalent to the pitches of a bulb thread of a bulb adapted to be received by said bulb holder so as to engage said projecting points with the bulb thread for affixing the bulb in position.

2. The C type lamp string according to claim 1 wherein said first contact containing a notch so as to facilitate a bending of said first contact end.

3. The C type lamp string according to claim 1 wherein each of said first and second sharp points containing two sharp projections for tightly holding said first and second cores, respectively, after said covering of said cord is pierced.

4. The C type lamp string according to claim 1 wherein each of said first and second fixing ends containing a protrusion for preventing said plastic material from contacting said sharp points during said injection molding process for making said lamp holder.

* * * * *